United States Patent [19]

Chang et al.

[11] Patent Number: 4,480,604

[45] Date of Patent: Nov. 6, 1984

[54] ENGINE BLOCK HEATER

[75] Inventors: Yih-Yi Chang, Willowdale; Rein Kungla, Scarborough, both of Canada

[73] Assignee: Budd Canada Inc., Kitchener, Canada

[21] Appl. No.: 438,626

[22] Filed: Nov. 2, 1982

[30] Foreign Application Priority Data

Nov. 12, 1981 [CA] Canada ..... 389875

[51] Int. Cl.[3] ..... F02N 17/06; H05B 3/02

[52] U.S. Cl. ..... 123/142.5 E; 219/208; 219/318; 219/336; 219/536

[58] Field of Search ..... 123/142.5 R, 142.5 E; 219/205, 208, 318, 335, 336, 536

[56] References Cited

U.S. PATENT DOCUMENTS 3,148,268 5/1964 Heinbuch ..... 123/142.5 E 3,165,621 1/1965 Windsor ..... 123/142.5 R

*Primary Examiner*—Ira S. Lazarus

*Attorney, Agent, or Firm*—Stanley G. Ade

[57] ABSTRACT

An engine block heater adapted for insertion through an opening in the block wall of an internal combustion engine has a novel arrangement for securing the heater within the opening of the block wall. The heater includes a plug member having a heating element and an adjustable fastening assembly extending from one side of the heater into the interior of the engine block. The fastening assembly passes through the plug member for adjustment from outside the block. A spiral spring is further included having its center positioned in fixed relation with the fastening assembly. The spring spirals towards the one side of the plug member. Additionally, two wing members are mounted in pivotal relation with the fastening assembly through an intermediate support member threadably mounted on the fastening assembly. The wing members have an inverted V shape with respect to the one side of the plug member when positioned within the spiral so as to facilitate insertion of the plug member into the aperture. The wing members may also extend substantially along a longitudinal path so as to have a diameter larger than that of the aperture when the wing members are drawn against the one side of the plug member by adjustment of the fastening assembly. In this latter position, the wing members secure the plug member in the aperture. The advantage found in this novel arrangement is that it is possible to repeatedly insert and remove the heater from the engine block.

10 Claims, 3 Drawing Figures

ENGINE BLOCK HEATER

This invention relates to improvements in engine block heaters for automobiles. In particular, it relates to the improvements in the method of retaining the heaters in the core hole of the engine block.

In the construction of internal combustion engines adapted to be water-cooled it is common practice to cast the cylinder block and water jacket in one piece using sand moulding. Apertures are provided for the removal of sand following the casting operation; when the engines are finally assembled the apertured may be sealed with suitable dished plates.

Commonly these apertures may be used for fitting electrical heating means into the engine. Some prior art engine block heaters finding particular application in automobile engines having special limitations in the block are disclosed in U.S. Pat. No. 3,766,356, issued Oct. 16, 1973 to Feldmann; U.S. Pat. No. 4,175,229 issued Nov. 20, 1979 to Brinkhof et al and Canadian patent application Ser. No. 336,783 filed Sept. 28, 1979 in the name of Brinkhof et al. The engine block heaters described in these references employ a yolk assembly which normally has an outside diameter less than the diameter of the aperture provided in the engine block to facilitate insertion of the heater through the aperture into the engine block. A fastening means in the form of a screw is provided for deforming the yolk assembly. This screw is attached to a pressure bar which may be drawn towards the plug of the heater to deform the yolk assembly. Once deformed, the yolk assembly has an outside diameter that is larger than the diameter of the aperture in the block wall of the engine block. The pressure bar holds the deformed yolk assembly against the block wall so as to maintain the heater in secure relation with the engine block. While removal of this type of heater involves loosening the screw, moving the pressure bar away from the plug member, and subsequently pulling the heater out of the engine block, the yolk assembly has to redeform into a diameter less than that of the aperture in the block wall to permit removal of the heater. Such deforming and redeforming of the yolk assembly for respectively inserting and removing the engine block heater stresses the material used in the yolk assembly. In practice, the yolk assembly only permits insertion and removal of the heater a limited number of times.

While U.S. Pat. No. 2,024,871, issued Dec. 17, 1935 to Parsons discloses a securing device having a toggle bolt and associate mechanism designed to facilitate the ready removal of the bolt and toggle, such device does not find application in engine block heaters. The device disclosed in this U.S. patent includes a sleeve projecting into an aperture. Through the sleeve passes a screw. Mounted via a support bar to the screw within the sleeve are wings. Slots are provided in the sleeve through which the wings may move to open and engage the wall to which the fastening device is to be secured. The use of a slotted sleeve presents an expensive device in terms of material costs. Also the wings of this device may be subjected to jamming problems.

It is therefore an object of the present invention to provide a securing assembly for an engine block heater that is relatively inexpensive and permits the engine block heater to be repeatedly inserted into and removed from the engine block.

Briefly, the present invention provides a heater suitable for use in an automobile engine block. The heater comprises a plug member which is insertable into an aperture of the block. The plug member has extending from one side thereof for insertion into the block, a heating element and an adjustable fastening means. The fastening means passes through the plug member for adjustment from outside the block. Attached in fixed relation with the fastening means is a spiral spring means. The spiral means is centered about the fastening means and spirals towards the one side of the plug member. A clamping means for securing the plug means in the aperture is provided. The clamping means includes a pair of wing members mounted in pivotal relation with the fastening means. The wing members have an inverted V shape with respect to the one side of the plug member when positioned within the spiral spring means. In this position, the wing members facilitate insertion of the plug member into the aperture of the block. The wing members may also extend substantially along a longitudinal path and have a diameter larger than that of the block apertures when the wing members are drawn towards the one side of the plug member by adjustment of the fastening means. In this latter position, the wing members secure the plug member in the block aperture. Provision of the pivotal mounting relation between the wing members and the fastening means allows for repeated insertion and removal of the heater from the block. The provision of the spiral spring means provides a relatively inexpensive structure that houses the wing members in a position which facilitates the insertion of the heater into the block.

Additionally, the adjustable fastening means may comprise a screw element loosely journalled in a central opening of the plug member. Also, the wing members may be loosely connected in pivotal relation with an intermediate support member threadably mounted on the screw. The features of having the screw element loosely journalled, having the wing members loosely connected in pivotal relation with the intermediate support member, and employing a spiral spring means provide the advantage that the wing members do not jam when moved from the position where they extend longitudinally into the inverted V position.

Further, the ends of the wing members, which diverge away from each other when the wing members are moved into a longitudinally extending position, may be rounded. This latter feature taken in conjunction with the loosely journalled screw element and loosely mounted wing members ensures that the wing members do not jam against a shoulder which may be present between the one side of the plug member and the interior wall of the block.

For better understanding of the nature and objects of the present invention, reference may be had by way of example to the accompanying diagramatic drawings for the preferred embodiment of the present invention in which.

Figure 1:
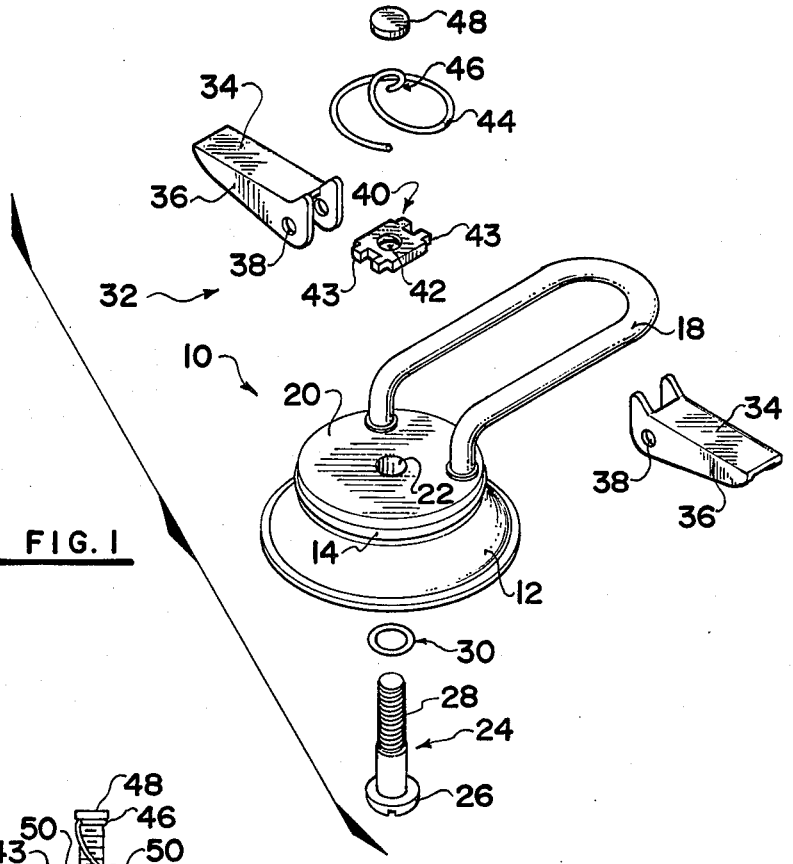
FIG. 1 is a perspective exploded view of the electric heater.
Figure 3:
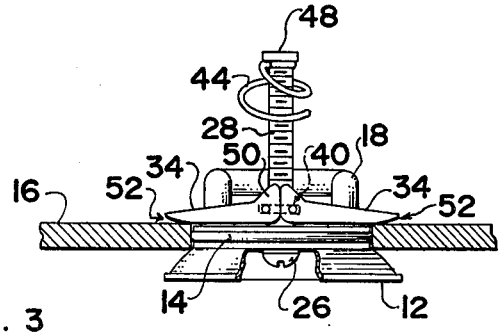

Referring to FIGS. 1 and 3, the engine block heater of the preferred embodiment is shown generally at 10.

Heater 10 comprises a plug-like body member 12. An O ring 14 is located in a groove on the peripheral surface of the plug member 12 to provide a fluid tight seal between plug member 12 and the engine block wall 16. A cranked metal sheathed heating element 18 extends from one side 20 of the plug member 12. Plug member 12 has a central opening 22 through which passes a fastening means illustrated by screw element or machine screw 24. The screw 24 has its head 26 excessible from outside the block wall 16 and has its shank 28 extending from one side 20. A second O ring 30 provides a fluid tight seal between plug member 12 and the screw element 24. Screw element 24 is loosely journalled in aperture 22 of the plug member 12.

Heater 10 further includes clamping means shown generally at 32. Clamping means 32 comprises a pair of wing members 34 having upstanding sidewalls 36. Aligned apertures 38 are provided in the upstanding wall 35 of each of the wing members 34. The clamping means 32 further includes an intermediate support member 40 having an aperture 42 which permits the intermediate support member 40 to be threadably mounted on screw 24. The intermediate support member 40 further includes protruding members 43 which are insertable into respective apertures 38 of wing members 34. The inside diameter of apertures 38 is slightly larger than the outside dimensions of protrusions 43 such that wing members 34 are loosely connected to the intermediate support member for pivotal movement therewith.

Also secured to the screw 24 is a spiral spring means 44. Spiral spring 44 has its center 46 secured in fixed relation with shank 28 of the screw 24 by means of lock washer 48. Spiral spring 44 spirals towards the one side 20 of plug member 12.

Figure 2:
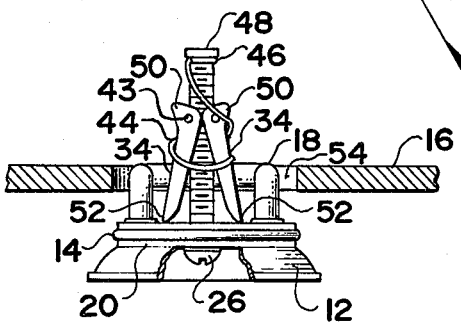
FIG. 2 is a side sectional view of the heater shown with the wing members in a position to facilitate the insertion of the heater into the engine block; and, FIG. 3 is a side sectional view of the heater shown with the wings in a longitudinally extending position securing the heater in the block.

Referring to the figures and particularly to FIGS. 2 and 3, securement of heater 10 in engine block wall 16 is described. Heater 10 shown in FIG. 2 has its wing members positioned in an inverted V shape with respect to one side 20 of plug member 12. For the purpose of definition, the wing members 34 may be said to have a first end portion 50 mounted in pivotal relation with intermediate support member 40. Also the wing members have a second end portion 52 shown in FIG. 2 in contacting relation with the one side 20 of plug member 12. The outside diameter of the wing members 34, which would be taken to be the distance between the end portions 52 of wing member 36, is clearly illustrated in FIG. 2 to be less than the diameter of aperture 54 in the engine block wall 16. Thus the heater 10 may be inserted into the block through aperture 54 of block wall 16. Fastening means illustrated by screw 28 is adjusted by turning screw head 26. This permits for the wing members 34 to be drawn into the position shown in FIG. 3. In the position in FIG. 3 the wing members 34 are extending substantially along a longitudinal path and have a diameter between the end portion 52 larger than the diameter of aperture 54 of block wall 16. In moving between the position shown in FIG. 2 and FIG. 3, the second ends 52 of the wing members 34 diverge across the one side 20 of the plug 12. To compensate for a shoulder that may be provided between the interior side of engine block wall 26 and the one side 20 of plug 12, the second end portions 52 of wing members 34 are rounded. This rounded feature together with the loosely journalled screw 24 and the loosely connected pivotal mounting of wing members 34 ensure that the wing members 34 do not jam when moving from positions shown in FIG. 2 to the position shown in FIG. 3 where the wing members secure the block heater 10 in the engine block. Referring to FIG. 3, the first end portions 50 of the wing members 34 are provided with ears which abut to limit movement of the wing members to the longitudinal extension when the wing members are drawn toward the one side 20 of plug member 12.

To effect removal of heater 10 from the engine block, screw 24 may be rotated to move the wing members 34 away from the one side 20 of plug member 12. As the wing members 34 come into contact with spring 44, spring 44 causes the wing members 34 to pivot about protrusions 43 of the intermediate support member 40. As a result, the wing members take the shape as illustrated in FIG. 2. The resiliency of the spring 44 ensures that the wing members 24 do not jam when being moved back into the position shown in FIG. 2.

It should be understood that the foregoing has been a description of the preferred embodiment of the present invention and that alternate embodiments may be readily apparent to a man skilled in the art in view thereof. Accordingly, the present invention should only be limited to that which is claimed in the accompanying claims.

We claim:

1. A heater suitable for use in an automobile engine block, comprising:

a plug member having a heating element and an adjustable fastening means extending from one side thereof, said plug member adapted for insertion into an aperture of said block with said heating element extending into said block;

said fastening means passing through said plug member for adjustment from outside and said block;

clamping means for securing said plug member in said aperture including a pair of wing members, and intermediate support member, said wing members each including at one end aligned apertures for cooperation with opposing protruding members of said support member so as to be pivotally movable from a first portion having an inverted V shape with respect to the one side of said plug member so as to facilitate insertion of said plug member into said aperture to a second position wherein said wing members extend substantially along a longitudinal path and have a transverse extent larger than that of said aperture for engaging a rear surface of the apertured block and means interconnecting said fastening means and said support member for drawing said support member and wing member from said first position to said second position.

2. The heater of claim 1 wherein said intermediate support member is threadably mounted on said adjustable fastening means.

3. The heater of claim 1 wherein said wing members have second end portions that diverge across the one side of said plug member when said wing members are drawn toward said one side.

4. The heater of claim 1 wherein said adjustable fastening means comprises a screw element loosely journalled in a central opening in said plug member.

5. The heater of claim 2 wherein said wing members are loosely connected in pivotal relation with said intermediate support member.

6. The heater of claim 1 wherein said wing members are loosely mounted in pivotal relation with said fastening means.

7. The heater of claim 1 wherein said one end of said wing members abut to limit movement of said wing members when the wing members are drawn into said second position toward the one side of said plug member.

8. The heater of claim 3 wherein the end portions of said wing members remote from said one end are rounded whereby as the ends slide outwardly toward said second position the ends can traverse a step between said one side of said plug member and said rear surface of the apertured block.

9. A heater suitable for use in a automobile engine block, comprising: a plug member having a heating element and an adjustable elongate fastening means extending from one side thereof, said plug member adapted for insertion into an aperture of said block with said heating element extending into said block; said fastening means passing through said plug member for adjustment from outside said block; axially extending spiral spring means having its centre positioned in fixed relation with said fastening means, spiralling around said fastening means toward said one side of said plug member; and clamping means for securing said plug member in said aperture including a pair of wing members, means mounting said wing members relative to said fastening means whereby the wing members are pivotally movable by said fastening means from a first position having an inverted V shape with respect to the one side of said plug member within said spiral spring means so as to facilitate insertion of said plug member into said aperture to a second position in which said wing members are spaced from said spring means and extend substantially along a longitudinal path with a transverse extent larger than that of said aperture so as to engage a rear surface of the apertured block.

10. A heater suitable for use in an automobile engine block, comprising: a plug member having a heating element and an adjustable fastening means extending from one side thereof, said plug member adapted for insertion into an aperture of said block with said heating element extending into said block; said fastening means passing through said plug member for adjustment from outside said block; and clamping means for securing said plug member in said aperture including a pair of opposed wing members means mounting said wing members relative to said fastening means whereby the wing members are pivotally movable by said fastening means from a first position having an inverted V shape with respect to the one side of said plug member so as to facilitate insertion of said plug member into said aperture, to a second position in which said wing members extend substantially along a longitudinal path and have a transverse extent larger than that of said aperture so as to engage a rear surface of said apertured block, said wing members each having an inner end at said mounting means and an outer end for engaging said rear surface, said inner ends being arranged to abut in said second position to limit pivotal movement of the wing members and said outer ends being curved whereby as the outer ends slide outwardly toward said second position the ends can traverse a step between said one side of said plug member and said rear surface of the apertured block.

* * * * *